US007944663B2

(12) United States Patent
Morino

(10) Patent No.: US 7,944,663 B2
(45) Date of Patent: May 17, 2011

(54) OVER-CURRENT PROTECTION CIRCUIT

(75) Inventor: Kohichi Morino, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 433 days.

(21) Appl. No.: 12/149,240

(22) Filed: Apr. 29, 2008

(65) Prior Publication Data

US 2008/0285198 A1 Nov. 20, 2008

(30) Foreign Application Priority Data

May 15, 2007 (JP) ..... 2007-128769

(51) Int. Cl.

| | |
|---|---|
| ***H02H 3/08*** | (2006.01) |
| ***H02H 9/02*** | (2006.01) |
| *H02H 9/08* | (2006.01) |
| *H02H 3/00* | (2006.01) |
| *H02H 7/00* | (2006.01) |
| *H02H 9/00* | (2006.01) |
| *G05F 1/00* | (2006.01) |

(52) U.S. Cl. ..... 361/93.1; 361/93.7; 361/93.9; 361/87; 361/18; 323/274

(58) Field of Classification Search ..... 361/93.1, 361/93.7, 93.9

See application file for complete search history.

(56) References Cited

U.S. PATENT DOCUMENTS

| | | | | |
|---|---|---|---|---|
| 7,411,376 | B2 * | 8/2008 | Zhang | 323/277 |
| 2003/0128489 | A1 | 7/2003 | Katoh et al. | |
| 2005/0036246 | A1 | 2/2005 | Nagata et al. | |
| 2007/0115045 | A1 * | 5/2007 | Nagata et al. | 327/540 |
| 2007/0176582 | A1 * | 8/2007 | Okuda et al. | 323/280 |

FOREIGN PATENT DOCUMENTS

| | | |
|---|---|---|
| JP | 2004-234619 | 8/2004 |
| JP | 2005-175439 | 6/2005 |
| JP | 3782726 | 3/2006 |

* cited by examiner

*Primary Examiner* — Dharti H Patel
(74) *Attorney, Agent, or Firm* — Dickstein Shapiro LLP

(57) ABSTRACT

An over-current protection circuit for use with a constant voltage circuit that converts an input voltage to a predetermined output voltage and that outputs the predetermined output voltage. The over-current protection circuit includes an output current detecting circuit configured to output an output current detecting voltage proportional to an output current outputted from the constant voltage circuit; an output current control circuit configured to control the output current outputted from the constant voltage circuit according to the output current detecting voltage outputted from the output current detecting circuit; an output voltage detecting circuit configured to output at least an output voltage detecting voltage according to the output voltage of the constant voltage circuit; and a conversion rate altering circuit configured to alter a conversion rate of the output current to the output current detecting voltage of the output current detecting circuit according to the output voltage detecting voltage outputted from the output voltage detecting circuit.

5 Claims, 8 Drawing Sheets

OVER-CURRENT PROTECTION CIRCUIT

CROSS-REFERENCE TO RELATED APPLICATION(S)

This application claims the benefit of the filing date of Japanese Patent Application No. 2007-128769, filed May 15, 2007, which is incorporated herein by reference in its entirety.

BACKGROUND

The present invention relates generally to an over-current protection circuit of a constant voltage circuit. The present invention also relates to an over-current protection circuit having an output characteristic that resembles a stair shape. Moreover, the present invention relates to an electric apparatus that includes an over-current protection circuit.

FIG. 7 of Japanese Patent No. 3782726 (Japanese Patent Publication No. 2003-186554) shows an over-current protection circuit of a constant voltage circuit shown in FIG. 8. FIG. 9 of Japanese Patent No. 3782726 is a chart that illustrates output characteristics of the circuit of FIG. 8. The output characteristic chart of FIG. 9 indicates a relationship between an output voltage Vout and an output current Iout of the circuit of FIG. 8.

FIGS. 8 and 9 of Japanese Patent No. 3782726 correspond to a conventional over-current protection circuit. In FIG. 8, a reference voltage Vref and a divided voltage are provided as inputs to an error amplifier (AMP). The divided voltage is provided by dividing the output voltage Vout using resistors R13 and R14.

The error amplifier (AMP) amplifies a difference between the reference voltage Vref and the divided voltage to provide a control signal that controls an output control transistor M16. A gate of the output control transistor M16 receives the control signal, so that the output voltage Vout at a drain of the output control transistor M16 is controlled to a predetermined voltage value.

The output transistor M16 and a current detecting transistor M11 are P-channel type MOS (PMOS) transistors, having respective sources that are connected to each other and respective gates that are connected to each other. A drain current Id11 of the current detecting transistor M11 is proportional to a drain current of the output control transistor M16.

The drain current Id11 is separated into three paths. One of three paths includes a resistance R15 and an N-channel MOS (NMOS) transistor M17, the second of three paths includes a resistance R11 and an NMOS transistor M12, and the third of three paths includes an NMOS transistor M14.

The output voltage Vout is divided to provide a divided voltage to the gates of NMOS transistor M17 and NMOS transistor M12. A voltage that is used to power the over-current protection circuit is referred to as a rating voltage. When the output voltage Vout is equal to the rating voltage, the divided voltages provided to the gates of the respective NMOS transistors M17 and M12 are greater than the respective threshold voltages of NMOS transistors M17 and M12, thereby turning on NMOS transistors M17 and M12.

NMOS transistors M15 and M14 form a current mirror circuit. A drain current of the NMOS transistor M15 is proportional to a drain current of the NMOS transistor M14. The drain current of the NMOS transistor M15 connects to a resistance R12 serially. Accordingly, a voltage drop occurs across the resistance R12 to provide an electric potential at a gate of a PMOS transistor M13. A drain of the PMOS transistor M13 is connected to the gate of output control transistor M16.

A conventional technique for generating an output characteristic that resembles a stair shape will now be described. When an output current of the constant voltage circuit shown in FIG. 8 of Japanese Patent No. 3782726 rises (cf. reference "a") until it reaches a limit current 1 (cf. FIG. 9), a value of the voltage provided by resistance R12 decreases to the threshold voltage of the PMOS transistor M13, and the PMOS transistor M13 is turned off. At that time, a gate voltage potential of the output control transistor M16 is inhibited from decreasing, and the output current Iout is inhibited from increasing. Thus, the output voltage Vout decreases to correspond to a limit current 1 value (cf. (b)).

When the output voltage Vout decreases, the gate voltage potential of the NMOS transistors M17 and M12 decreases. First, when the gate voltage potential of the NMOS transistor M17 that is smaller than the divided voltage of the output voltage Vout decreases to a value less than the threshold potential, the NMOS transistor M17 turns off. When the NMOS transistor M17 turns off, a part of the drain current of the current detecting transistor M11 that flowed through the resistance R15 and the NMOS transistor M17 does not flow. Rather, this part of the drain current is added to the drain current of the NMOS transistor M14.

As a result, since the voltage drop across the resistance R12 increases, the gate potential of the PMOS transistor M13 decreases more. Thus, an on-state resistance value of the PMOS transistor M13 decreases, and the gate potential of the output control transistor M16 is pulled up more. Therefore, the output current Iout decreases to a limit current 2 of FIG. 9 (cf. (c)).

Furthermore, when the output Vout decreases, the NMOS transistor M12 is turned off, and a part of the drain current of the current detecting transistor M11 that flowed through the resistance R11 and the NMOS transistor M12 does not flow. Rather, this part of the drain current is added to the drain current of NMOS transistor M14.

As a result, since the voltage drop across the resistance R12 increases, the voltage potential at an output of the resistance R12 decreases more. Since the gate potential of the PMOS transistor M13 decreases further, the gate potential of the output control transistor M16 is pulled up more. Thus, the output current Iout decreases to a limit current 3 of FIG. 9 (cf. e).

As described above, the output current Iout of the constant voltage circuit shown in FIG. 8 of Japanese Patent No. 3782726 can decrease in a manner that resembles a stair shape corresponding with the decreasing output voltage Vout.

Japanese Patent Application No. 2004-233619 describes similar conventional art.

SUMMARY OF THE INVENTION

Applicant investigated the systems shown in Japanese Patent No. 3782726 and Japanese Patent Application No. 2004-233619 and found problems in the ways in which they operate. That is, in operation, the output voltage Vout is divided to provide the divided voltage at the gates of NMOS transistor M17 and NMOS transistor M12, as shown in FIG. 8 of Japanese Patent No. 3782726, for example. An output voltage Vout level when the NMOS transistors M12 and M17 shown in FIG. 9 turn off can not be set less than the threshold voltage of the NMOS transistors M12 and M17.

Recently, as an active voltage of a circuit decreases for saving power consumption of an electric apparatus, an output voltage of a constant voltage circuit is required to decrease.

For example, in FIG. 10 of Japanese Patent No. 3782726, when an output voltage Vout is slightly higher than the threshold voltage of the NMOS transistors, changing points of the stair shape output characteristic (off point of the transistor M17, off point of the transistor M12) gather in the vicinity of the output voltage Vout, thereby limiting the over-current protection.

Furthermore, when the output voltage Vout is less than the threshold value, conventional circuits cannot be used.

The present invention is directed to an over-current protection circuit that addresses one or more of the aforementioned deficiencies of conventional over-current protection circuits. The present invention is also directed to an over-current protection circuit that can reduce a consumption power and an electric apparatus that includes the over-current protection circuit. Even if the output voltage Vout decreases below the threshold voltage of a transistor in the over-current protection circuit, the over-current protection circuit of the present invention is still capable of setting the limit current. Moreover, the present invention is directed to an over-current protection circuit that can provide an appropriate protection characteristic when an output voltage of a constant voltage circuit is low.

To achieve the above object, an over-current protection circuit for use in a constant voltage circuit that converts an input voltage to a predetermined output voltage and outputs the predetermined output voltage may include an output current detecting circuit configured to output an output current detecting voltage proportional to an output current outputted from the constant voltage circuit; an output current control circuit configured to control the output current outputted from the constant voltage circuit according to the output current detecting voltage outputted from the output current detecting circuit; an output voltage detecting circuit configured to output at least an output voltage detecting voltage according to the output voltage of the constant voltage circuit; and a conversion rate altering circuit configured to alter a conversion rate of the output current to the output current detecting voltage of the output current detecting circuit according to the output voltage detecting voltage outputted from the output voltage detecting circuit.

Accordingly, the output voltage of the constant voltage circuit may be voluntary set to a voltage value while the output current is being reduced. As an example, the output voltage detecting circuit may output the output voltage detecting voltage that is more than the output voltage of the constant voltage circuit. In another example, the output voltage detecting circuit may add a positive and/or negative offset voltage value to the output voltage of the constant voltage circuit to provide the output voltage detecting voltage. For instance, the offset voltage value may be generated by providing a constant current to a resistance.

A switch device may be configured to be able to operate the output voltage detecting circuit when the output current is greater than a predetermined current value. Such a configuration may enable the over-current protection circuit to have a lower current consumption than conventional over-current protection circuits.

As an example, the switch device may include a transistor that is connected to the input voltage and the output voltage detecting circuit, which is the same conductivity type (e.g., N-type or P-type) as an output control transistor that controls the output voltage of the constant voltage circuit. A source of the transistor is connected to a source of the output control transistor, and a gate of the transistor is connected to a gate of the output control transistor. A threshold voltage of the transistor is greater than a threshold voltage of the output control transistor. Thus, the over-current protection circuit need not necessarily form a redundant circuit.

In another example, the output current detecting circuit may include a second transistor, a first resistance, a second resistance, and a third resistance. In this example, the second transistor is connected between the input voltage and a reference potential (e.g., a ground voltage) in series. The second transistor is the same conductivity type (e.g., N-type or P-type) as the output control transistor. A source of the second transistor is connected to the source of the output control transistor, and a gate of the second transistor is connected to the gate of the output control transistor. The output voltage detecting circuit includes a first current source, a fourth resistance, a fifth resistance, and a second current source serially-connected between the switch device and the reference potential. The conversion rate altering circuit includes a third transistor and a fourth transistor. A drain of the third transistor is connected to a node between the first resistance and the second resistance. A source of the third transistor is connected to the reference potential. If the output control transistor is an N-type transistor, then the third transistor is a P-type transistor. On the other hand, if the output control transistor is a P-type transistor, then the third transistor is an N-type transistor.

In this example, a drain of the fourth transistor is connected to a node between the second resistance and the third resistance. A source of the fourth transistor is connected to the reference potential. If the output control transistor is an N-type transistor, then the fourth transistor is a P-type transistor. On the other hand, if the output control transistor is a P-type transistor, then the fourth transistor is an N-type transistor. The output voltage of the output control transistor is connected to a node between the forth resistance and the fifth resistance of the output voltage detecting circuit.

A capacitor may have a first terminal connected to the reference potential and a second terminal connected to (1) a node between the first current source and the fourth resistance, (2) a node between the fifth resistance and the second current source, or (3) any point along the combination of the fourth resistance and the fifth resistance. Thus, the over-current protection circuit can limit a rush current without the need for a redundant rush current limit circuit.

An electronic apparatus may include an over-current protection circuit described herein. The electronic apparatus may be capable of operating stably, may not malfunction in response to noise, may consume less power than a conventional electronic apparatus, etc. The electronic apparatus may be a mobile electronic apparatus, a voltage regulator, DC-DC converter, a battery pack, an electronic device for an automobile, a household electrical appliance, etc.

The over-current protection circuit and the electric apparatus that includes the over-current protection circuit are capable of setting the limit current even if the output voltage decreases below the threshold voltage of a transistor in the over-current protection circuit. The over-current protection circuit and the apparatus can provide an appropriate protection characteristic when an output voltage of a constant voltage circuit is low. In addition, the over-current protection circuit and the apparatus can consume less power as compared to conventional over-current protection circuits and apparatuses. Moreover, the over-current protection circuit and the apparatus can limit a rush current without the necessity of a redundant rush current limit circuit.

In describing preferred embodiments illustrated in the drawings, specific terminology is employed for purposes of clarity. However, the disclosure of this patent specification is not intended to be limited to the specific terminology so used, and it is to be understood that substitutions for each specific element can include any technical equivalents that operate in a similar manner.

BRIEF DESCRIPTION OF DRAWINGS

FIG. 6-B shows charts illustrating waveforms of an input voltage, an output voltage and a rush current when the rush current is limited.

DETAILED DESCRIPTION OF PREFERRED EMBODIMENTS

Figure 1:
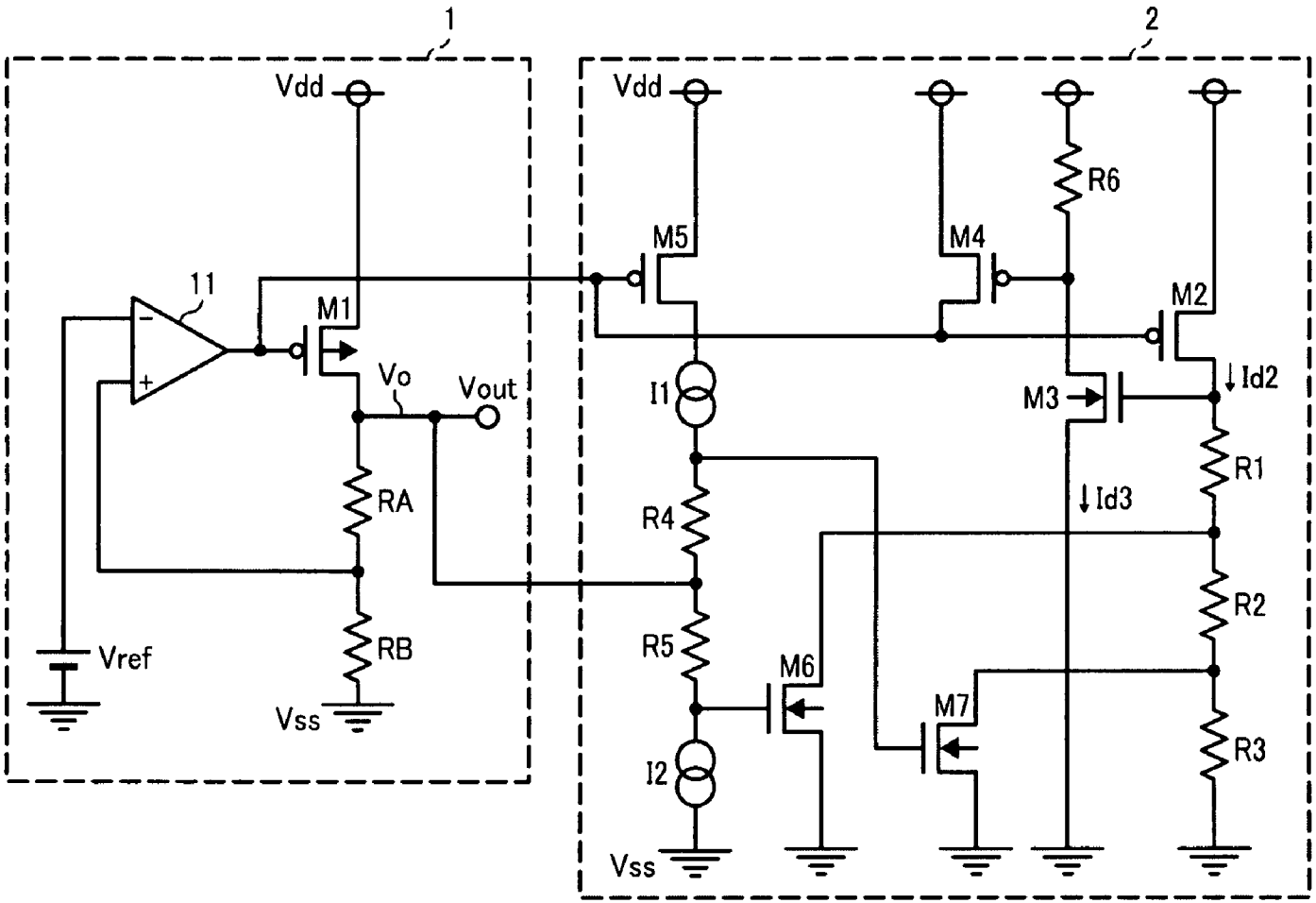
FIG. 1 is a circuit diagram illustrating a constant voltage circuit including an over-current protection circuit according to a first embodiment of the present invention.

Referring now to the drawings, like reference numerals designate identical or corresponding parts throughout the several views thereof, and in the first instance to FIG. 1, a constant voltage circuit according to exemplary embodiments of the present invention is described.

Figure 2:
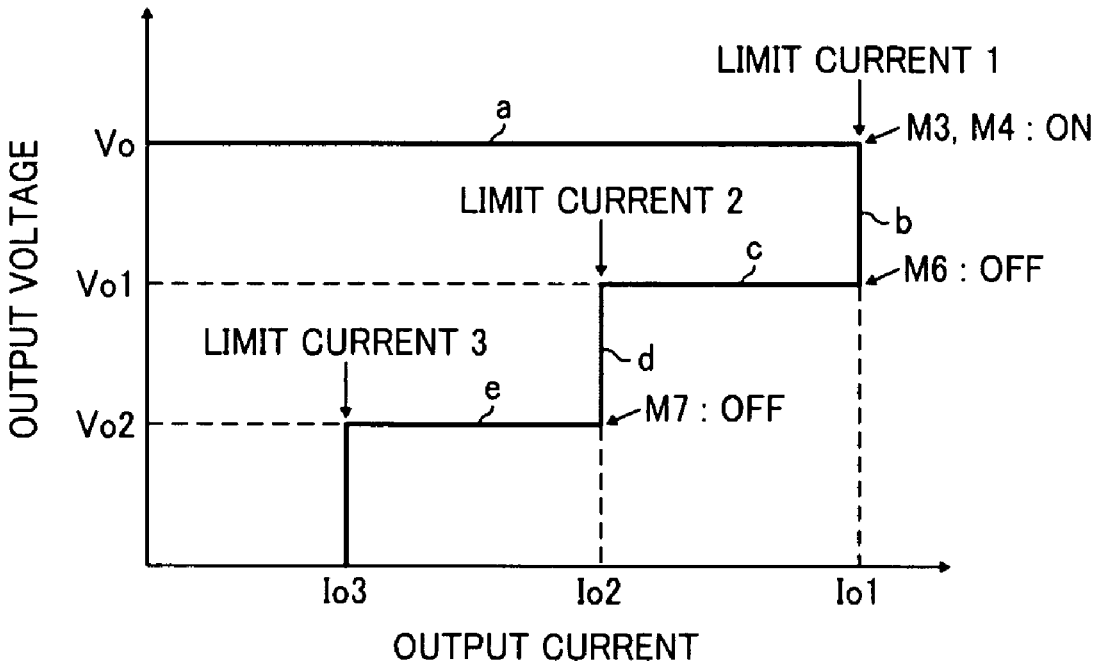
FIG. 2 is a chart illustrating an example relationship between an output voltage Vout and an output current Iout of the constant voltage circuit shown in FIG. 1.

FIG. 1 is a circuit diagram illustrating a constant voltage circuit including an over-current protection circuit according to a first embodiment of the present invention. FIG. 2 is a chart illustrating an example relationship between an output voltage Vout and an output current Iout of the constant voltage circuit shown in FIG. 1.

FIG. 1 shows a constant voltage circuit 1 and an over-current protection circuit 2. The constant voltage circuit 1 includes a reference voltage Vref, an error amplifier circuit I1, an output control transistor M1, a resistance RA and a resistance RB. The over-current protection circuit 2 includes PMOS transistors M2, M4 and M5, NMOS transistors M3, M6 and M7, resistances R1, R2, R3, R4, R5 and R6 and constant current sources I1 and I2.

The PMOS transistor M2 and resistances R1, R2 and R3 form an output current detecting circuit to output an output current detecting voltage in proportion to an output current Iout of the constant voltage circuit 1.

The NMOS transistor M3, the PMOS transistor M4 and the resistance R6 form an output current control circuit to control the output current Iout outputted from the constant voltage circuit 1.

The constant current sources I1 and I2 and the resistances R4 and R5 form an output voltage detecting circuit to output an output voltage detecting voltage changed in response to an output voltage Vout of the constant voltage circuit 1.

The PMOS transistor M5 forms a power source supply switch to turn on and/or off supplying power to the output voltage detecting circuit.

The NMOS transistor M6 and the NMOS transistor M7 form a conversion rate altering circuit to alter a conversion rate of an output current to an output current detecting voltage outputted from the output current detecting circuit in response to the output voltage detecting voltage of the output voltage detecting circuit.

In the first embodiment, a source and a gate of the PMOS transistor M2 are connected to a source and a gate of the output control transistor M1 of the constant voltage circuit 1 respectively. Therefore, a drain current Id2 of the PMOS transistor M2 is proportional to a drain current of the output control transistors M1.

The drain current of the output control transistors M1 is approximately the output current Iout. Thus, it can be said that the drain current Id2 of the PMOS transistor M2 is proportional to the output current Iout.

The drain current Id2 of the PMOS transistor M2 is supplied through the resistance R1 that is serially-connected between the drain of the PMOS transistor M2 and a reference potential Vss through the resistance R3. The drain current Id2 is converted into the output current detecting voltage.

The output current detecting voltage is output from a connection node at the drain of the PMOS transistor M2 and the resistance R1 and input to a gate of the NMOS transistor M3. A source of the NMOS transistor M3 connects to the reference potential Vss. A drain of the NMOS transistor M3 connects to an input voltage Vdd through the resistance R6. The drain of the NMOS transistor M3 further connects to a gate of the PMOS transistor M4. A source of the PMOS transistor M4 connects to the input voltage Vdd. A drain of the PMOS transistor M4 connects to the gate of output control transistor M1.

In the first embodiment, a source and a gate of the PMOS transistor M5 are connected to the source and the gate of the output control transistor M1 respectively. Therefore, a drain current of the PMOS transistor M5 is proportional to the output current Iout, as is the drain current of the PMOS transistor M2.

In addition, in the first embodiment, a threshold voltage of the PMOS transistor M5 is more than a threshold voltage of the output control transistor M1 because a gate length of the PMOS transistor M5 is longer than a gate length of the output control transistor M1.

Accordingly, when the output current Iout is relatively low, the PMOS transistor M5 turns off, and the output voltage detecting circuit that includes the constant current sources I1 and I2 and the resistances R4 and R5 is not provided a power supply.

In addition, if the output current Iout increases, a current greater than the constant current of the constant current source I1 is not provided at the drain of the PMOS transistor M5 because the drain of the PMOS transistor M5 is connected to the constant current source I1.

The constant current source I1 and the resistance R4 of the output voltage detecting circuit are serially connected between the drain of the PMOS transistor M5 and an output terminal (Vout) of the voltage circuit 1. More specifically, a first terminal of the constant current source I1 connects to the drain of the PMOS transistor M5, and a second terminal of the constant current source I1 connects to a first terminal of the resistance R4 at a first connection node. A second terminal of the resistance R4 connects to the output terminal (Vout) of the constant voltage circuit 1.

The constant current source I2 and the resistance R5 of the output voltage detecting circuit are serially connected between the output terminal (Vout) of the constant voltage circuit 1 and the reference potential Vss. More specifically, a first terminal of the constant current source I2 connects to the reference potential Vss, and a second terminal of the constant current source I2 connects to a first terminal of the resistance R5 at a second connection node. A second terminal of the resistance R5 connects to the output terminal (Vout) of the constant voltage circuit 1 and the second terminal of the resistance R4.

The first connection node between the constant current source I1 and the resistance R4 also connects to a gate of the NMOS transistor M7. A source of the NMOS transistor M7 connects to the reference potential Vss. A drain of the NMOS transistor M7 connects to a third connection node, which is connected to a second node of the resistance R2 and a first node of the resistance R3.

The second connection node between the constant current source I2 and the resistance R5 also connects to a gate of the NMOS transistor M6. A source of the NMOS transistor M6 connects to the reference potential Vss. A drain of the NMOS transistor M6 connects to a fourth connection node, which is connected to a second node of the resistance R1 and a first node of the resistance R2.

A voltage value that is a sum of the output voltage Vout and a product voltage of the resistance R4 and the constant current source I1 (R4×I1) is provided to the gate of the NMOS transistor M7. A voltage value that is a difference between the output voltage Vout and a product voltage of the resistance R5 and the constant current source I2 (R5×I2) is provided to the gate of the NMOS transistor M6.

When the output current Iout of the constant voltage circuit 1 is less than a limit current 1 (Io1) and the output voltage Vout is a rating voltage V0 (cf. (a) in FIG. 2), gate voltages of the respective NMOS transistors M6 and M7 are greater than their respective threshold voltages. Therefore, the fourth connection node between the resistance R1 and the resistance R2 becomes the reference potential Vss. A gate voltage of the NMOS transistor M3 therefore becomes a product voltage of the resistance R1 and the drain current Id2 (R1×Id2).

When the output current Iout of the constant voltage circuit 1 reaches the limit current 1 (Io1), the product voltage of the resistance R1 and the drain current Id2 becomes approximately the same as the threshold voltage of the NMOS transistor M3. As a result, the NMOS transistor M3 turns on, and a drain current Id3 is supplied across the resistance R6.

The gate of the output control transistor M1 is inhibited from decreasing because the PMOS transistor M4 turns on. Therefore, the output current Iout becomes less than the limit current 1 (Io1), and the output voltage Vout decreases.

The gate voltages of the NMOS transistors M6 and M7 decrease in response to a decrease of the output voltage Vout.

As mentioned above, the gate voltage of the NMOS transistor M6 is the difference between the output voltage Vout and the product voltage of the resistance R5 and the constant current I2 (R5×I2). The gate voltage of the NMOS transistor M7 is the sum of the output voltage Vout and the product voltage of the resistance R4 and the constant current I1 (R4×I1). When the output voltage Vout decreases, the NMOS transistors M6 and M7 turn off earlier.

At this time, the output voltage Vout is a voltage Vol.

When the NMOS transistor M6 turns off, the third connection node between the resistance R2 and the resistance R3 becomes the reference potential Vss by the NMOS transistor M7. A series combination of resistances R1 and R2 is connected between the drain of the PMOS transistor M2 and the reference potential Vss. Therefore, the gate voltage of the NMOS transistor M3 becomes (R1+R2)×Id2V.

The drain current Id3 of the NMOS transistor M3 increases, and a gate voltage of the PMOS transistor M4 decreases further. Because an on-state resistance of the PMOS transistor M4 becomes smaller, the gate voltage of the output control transistor M1 is pulled up. Therefore, the output current Iout decreases until it reaches a limit current 2(Io2). (cf. (c) at FIG. 2)

After the output current Iout decreases to the limit current 2(Io2), the output voltage decreases further. (cf. (d) at FIG. 2). The gate voltage of the NMOS transistor M7 is a sum voltage of the output voltage Vout and (R4×I1). When the output voltage Vout decreases to a voltage V02, the gate voltage of the NMOS transistor M7 is less than the threshold voltage of the NMOS transistor M7, causing the NMOS transistor M7 to turn off.

When the NMOS transistor M7 turns off, the series connection resistances R1,R2 and R3 connect between the drain of the PMOS transistor M2 and the reference potential Vss. Therefore, the gate voltage of the NMOS transistor M3 becomes (R1+R2+R3)×Id2 V. This causes the drain current Id3 of the NMOS transistor M3 to increase further and the gate voltage of the PMOS transistor M4 to decrease further. The gate voltage of the output control transistor M1 is pulled up, so that the on-resistance of the PMOS transistor M4 becomes lower.

As discussed above, the NMOS transistors M6 and M7 turn off sequentially with respective decreases of the output voltage Vout. The output current Iout decreases from Io1 to Io2 and from Io2 to Io3 sequentially to resemble a stair shape.

A voltage that is greater than the output voltage Vout is provided to the gate voltage of the NMOS transistor M7. Thus, even if the output voltage Vout is less than the threshold voltage of the NMOS transistor M7, the limit current is able to be reduced.

Although the above description and drawings utilize three limit current values for illustrative purposes, the invention is not to be limited in this respect. Persons skilled in the relevant art(s) will recognize that the invention may utilize any number of limit current values. The invention can utilize any arbitrary number of limit current values greater than two, for example.

The second embodiment inhibits the occurrence of a rush current. For instance, the over-current protection circuit of the first embodiment described above may be configured to include a capacitor.

A rush current is a current that flows to charge a capacitor connected between an output terminal and a reference potential for voltage stabilization when a voltage regulator starts to output an output voltage. At an instant when the output voltage is raised, a large current flows. The large current causes an over shoot of the output voltage.

Conventional techniques for inhibiting a rush current require a circuit to control a current limit value separately from a rush current limit circuit for limiting the rush current.

The second embodiment can limit the rush current merely by incorporating a capacitor into the current limit circuit of the first embodiment.

Figure 3:
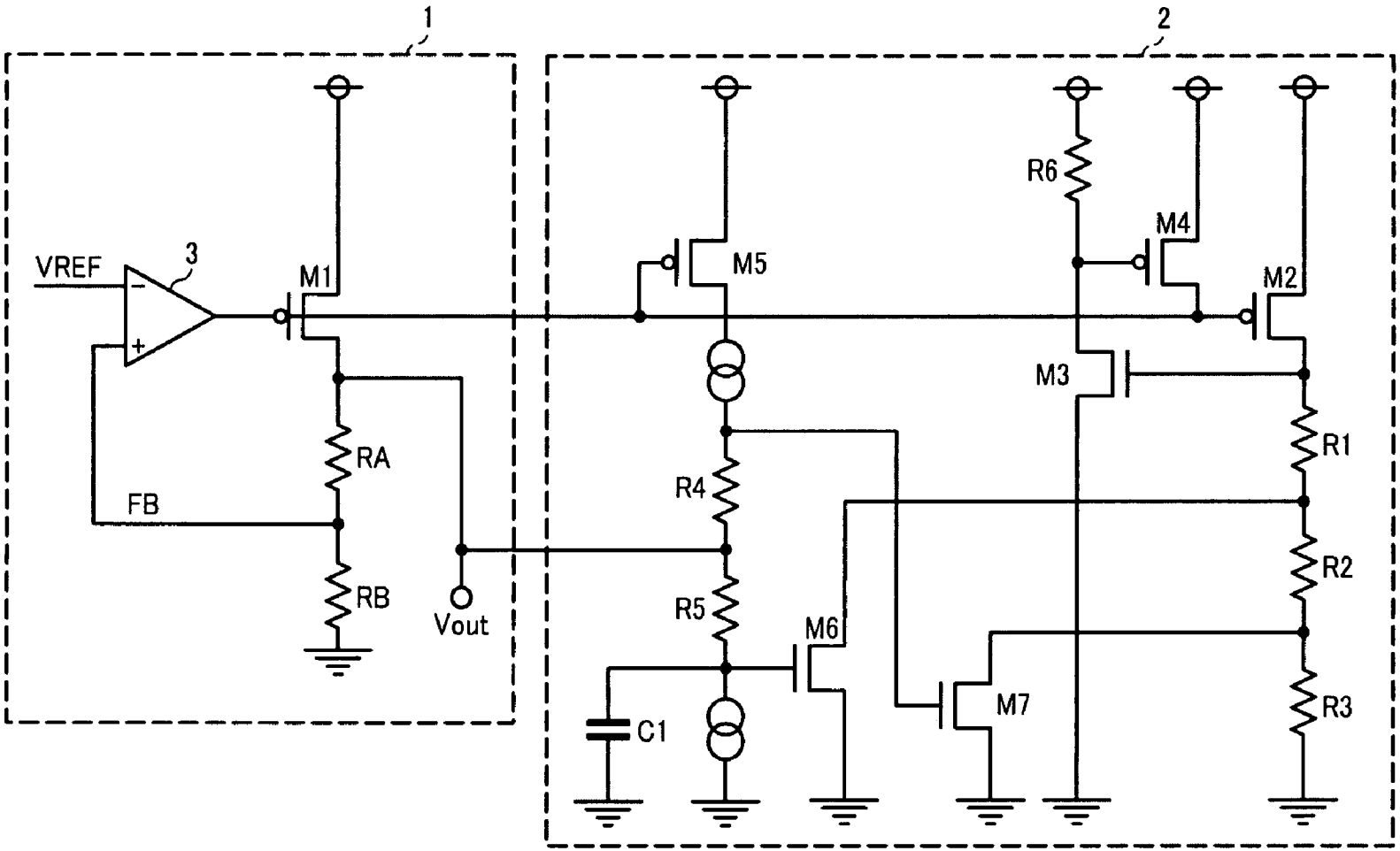
FIG. 3 is a circuit diagram illustrating a constant voltage circuit including an over-current protection circuit according to another embodiment of the present invention.
Figure 4:
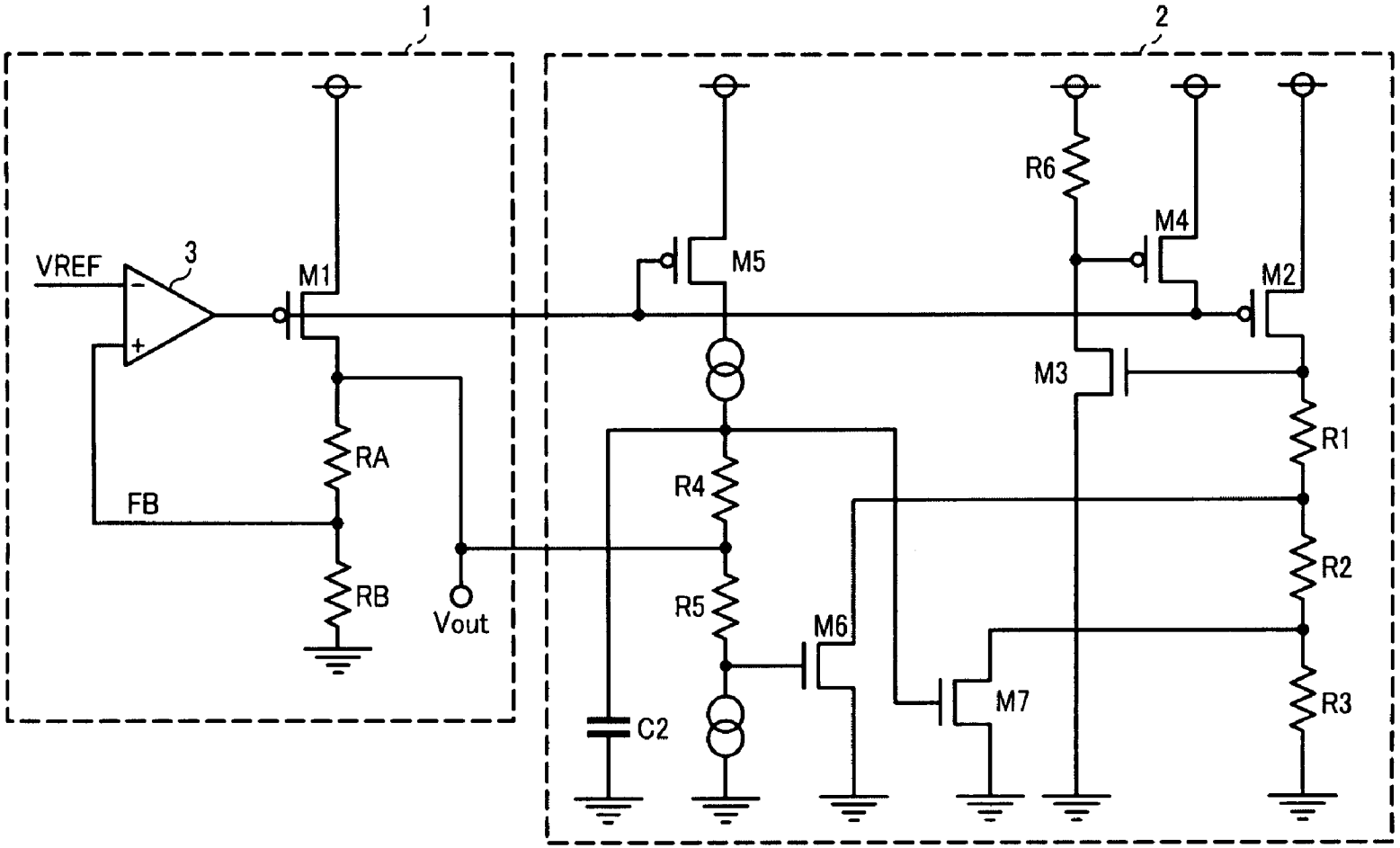
FIG. 4 is a circuit diagram illustrating a constant voltage circuit including an over-current protection circuit according to yet another embodiment.
Figure 5:
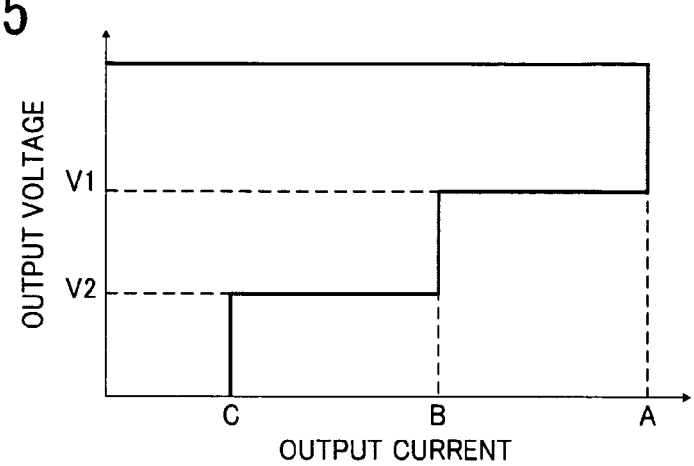
FIG. 5 is a chart illustrating an example output characteristic of an output voltage and an output current.
Figure 6A:
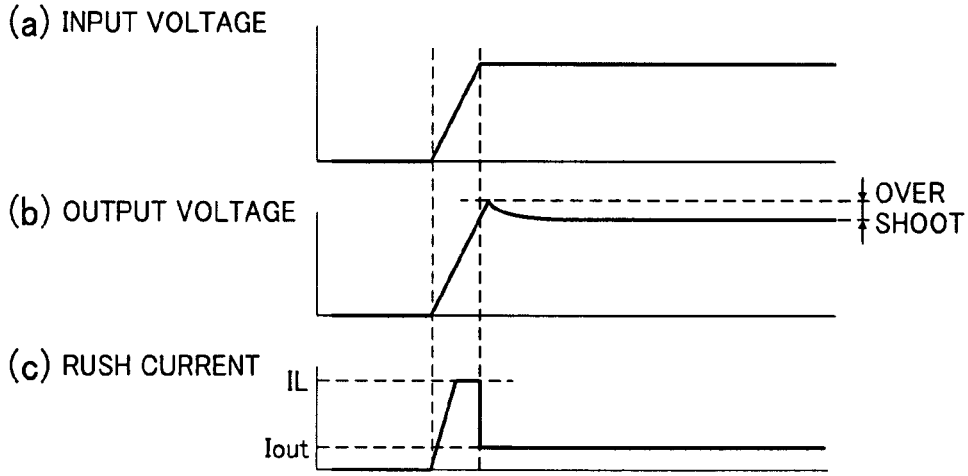
FIG. 6-A shows charts illustrating waveforms of an input voltage, an output voltage and a rush current when the rush current is not limited.
Figure 6B:
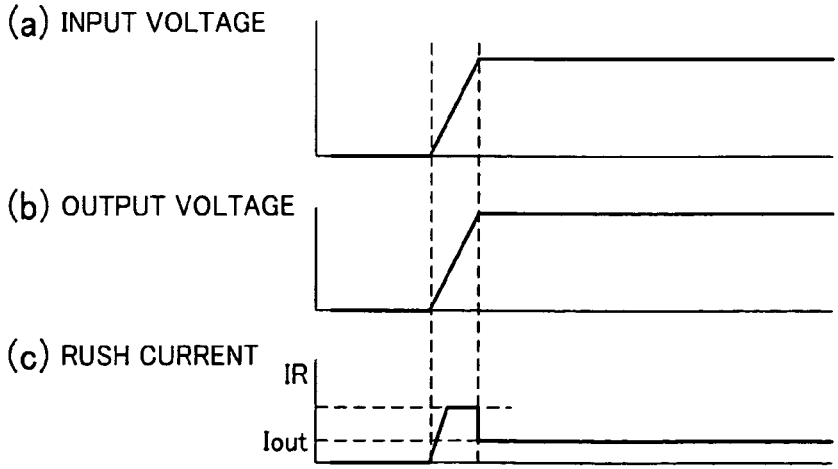

The second embodiment of the present invention is described with reference to FIGS. 3, 4, 5, 6-A and 6-B. FIGS. 3 and 4 are circuit diagrams illustrating constant voltage circuits including over-current protection circuits that incorporate a capacitor. FIG. 5 is a chart illustrating an example output characteristic of an output voltage and an output current. FIGS. 6-A and 6-B show charts illustrating waveforms of an input voltage, an output voltage and a rush current.

In FIG. 3, a capacitor C1 is connected between a gate of the NMOS transistor M6 and the reference potential. For instance, a first terminal of the capacitor C1 is connected to the gate of the NMOS transistor M6, and a second terminal of the capacitor C1 is connected to the reference potential. When the output voltage rises, the capacitor C1 delays the rise of the gate voltage of the NMOS transistor M6. The rush current is therefore limited to a limit current B, as shown in FIG. 5, for a period of time before the NMOS transistor M6 turns on.

The first terminal of the capacitor C1 optionally may be connected to a connection node that divides the resistance R5. This optional configuration provides an effect similar to that of the configuration shown in FIG. 3.

In FIG. 4, the capacitor C2 is connected between the gate of the NMOS transistor M7 and the reference potential. For instance, a first terminal of the capacitor C2 is connected to the gate of the NMOS transistor M7, and a second terminal of the capacitor C2 is connected to the reference potential. When the output voltage rises, the capacitor C2 delays the rise of the gate voltage of the NMOS transistor M7. The rush current is therefore limited to a limit current C, as shown in FIG. 5, for a period of time before the NMOS transistor M7 turns on.

The first terminal of the capacitor C2 optionally may be connected to a connection node that divides the resistance R4. This optional configuration provides an effect similar to that of the configuration shown in FIG. 4.

In the second embodiment, the rush current can be limited by connecting the first terminal of the capacitor C1 or C2 to any point between a node that connects the NMOS transistor M6 and the resistance R5 and a node that connects the NMOS transistor M7 and the resistance R4, and connecting the second terminal of the capacitor to the reference potential.

The first terminal of the capacitor C1 or C2 may be connected to any arbitrary point along a plurality of resistances that are connected in series, including the node that connects the NMOS transistor M6 and the resistance R5 and the node that connects the NMOS transistor M7 and the resistance R4.

FIG. 6-A shows charts illustrating waveforms of an input voltage (a), an output voltage (b) and the rush current (c) when the rush current is not limited. In chart (c) of FIG. 6-A, IL shows a rush flow to a current value of (A), as shown in FIG. 5. In other words, chart (c) shows an over shoot of the output voltage.

FIG. 6-B shows charts illustrating waveforms of an input voltage (a), an output voltage (b) and the rush current (c) when the rush current is limited. In chart (c) of FIG. 6-B, IR shows a rush flow to only the current values of (B) or (C) of FIG. 5.

The over-current protection circuit can be applied to electric apparatuses including but not limited to portable electric devises (e.g., a cellular telephone), voltage-regulators, DC-DC converters, battery packs, electric apparatuses for a car and household electrical appliances.

An electric apparatus that includes the over-current protection circuit can set the limit current even if the output voltage of a constant voltage circuit in the electric apparatus decreases below a threshold voltage of a transistor in the over-current protection circuit. The electric apparatus can provide an appropriate protection characteristic when an output voltage of the constant voltage circuit is low. In addition, the electric apparatus can reduce a consumption of power.

As mentioned above, the present invention can be applied to a wide variety of electric apparatuses in various fields.

Figure 7:
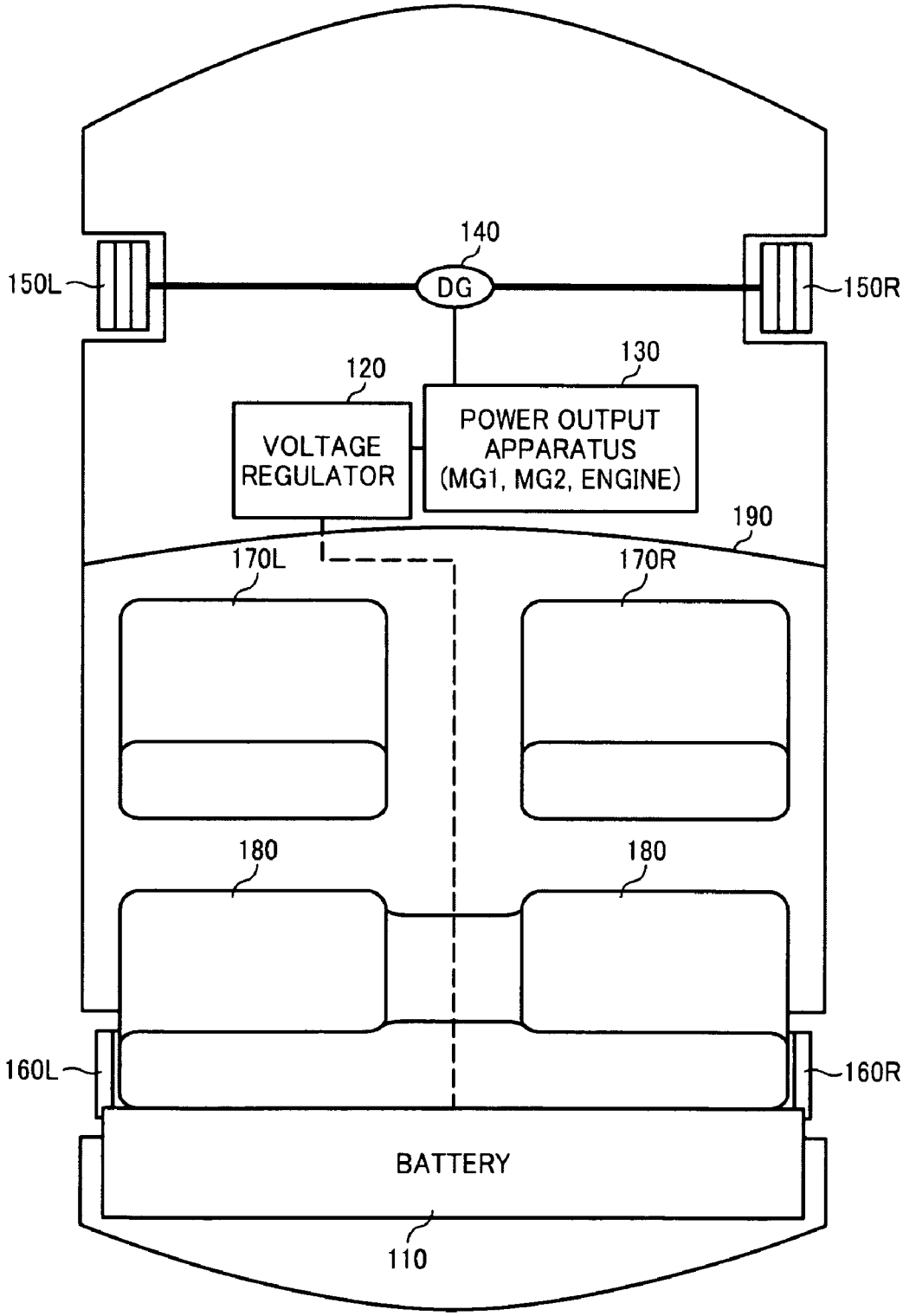
FIG. 7 is an example block diagram of a voltage regulator that has an over-current protection circuit.
Figure 8:
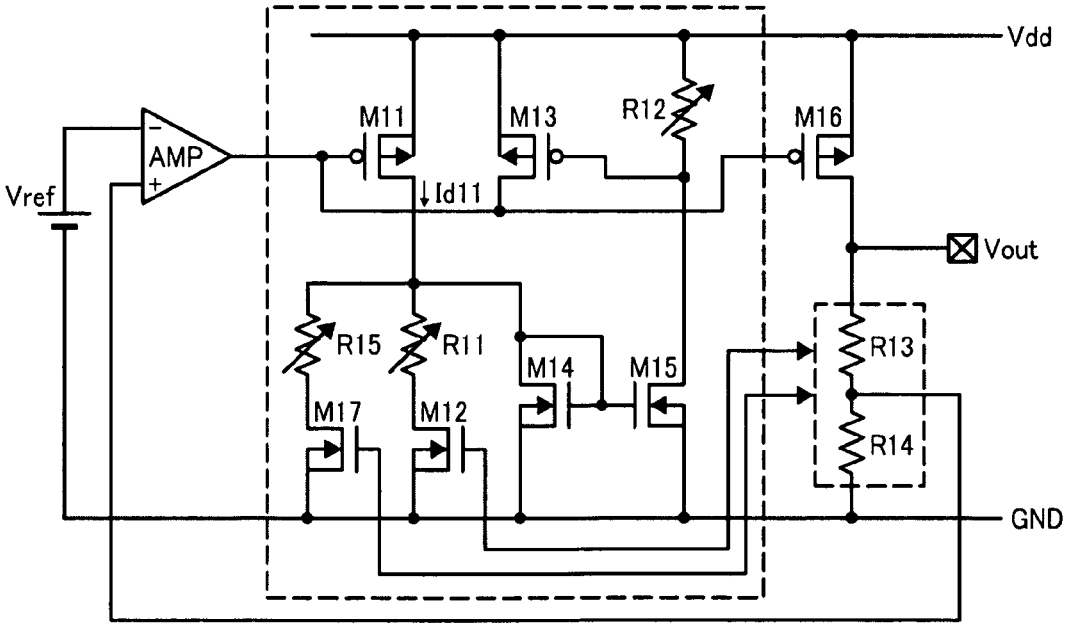
FIG. 8 PRIOR ART
FIG. 8 is a circuit diagram illustrating a constant voltage circuit including a conventional over-current protection circuit.
Figure 9:
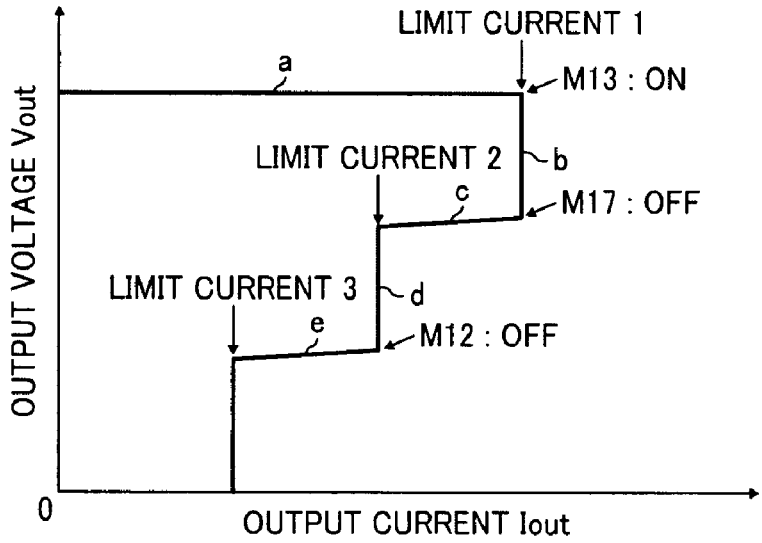
FIG. 9 PRIOR ART
FIGS. 9 and 10 are charts illustrating example relationships between an output voltage Vout and an output current Iout of the constant voltage circuit shown in FIG. 8.
Figure 10:
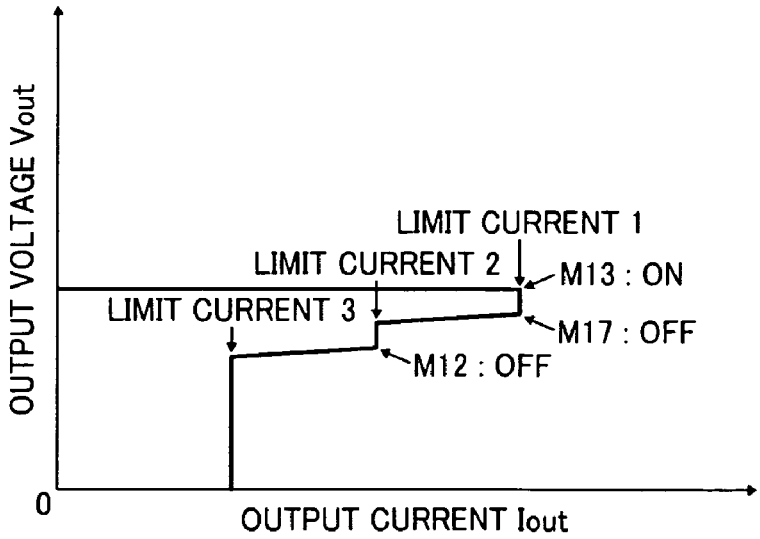
FIG. 10 PRIOR ART

FIG. 7 shows an embodiment where the over-current protection circuit is applied to a hybrid automobile of the type described in Japanese Patent Laid-Open No. 2005-175439 bulletin. FIG. 7 is an example block diagram of a voltage regulator that has the over-current protection circuit.

According to FIG. 7, the hybrid automobile has a battery 110, a voltage regulator 120 with an over-current protection circuit in accordance with the present invention, a power output apparatus 130, differential gears (DG) 140, front wheels 150L and 150R, rear wheels 160L and 160R, front seats 170L and 170R, a rear seat 180, and a dashboard 190. The basic operation of the automobile, but without the present invention, is illustrated in Japanese Patent Laid-Open No. 2005-175439 bulletin.

The battery 110 is connected to the voltage regulator 120 by an electric cable. The battery 110 supplies a direct current (DC) voltage to the voltage regulator 120, and the DC voltage of the voltage regulator 120 charges the battery 110. The voltage regulator 120 is connected to the power output apparatus 130 by electric cable. The power output apparatus 130 is coupled to the differential gear (DG) 140.

The voltage regulator 120 boosts the DC voltage of the battery 110. The voltage regulator 120 converts a boosted DC voltage to an AC voltage. Moreover, the voltage regulator 120 controls an operation of two motor generators MG1 and MG2 that are included in the power output apparatus 130. In addition, the voltage regulator 120 converts an AC voltage that is generated by the motor generator to a DC voltage, and charges the battery 110 by the DC voltage.

The voltage regulator 120 is included with an over-current protection circuit constructed in accordance with the present invention.

The hybrid automobile, which includes the over-current protection circuit, can set the current limit value of the over-current protection circuit even if the output voltage of a constant voltage circuit decreases below the threshold voltage of a transistor in the over-current protection circuit. The hybrid automobile can provide an appropriate protection characteristic when an output voltage of a constant voltage circuit is low. In addition, the electric apparatus can reduce a consumption power.

The entire disclosure of Japanese Patent Application No. 2007-124189, filed May 9, 2007, is incorporated herein by reference.

The above description and drawings are only to be considered illustrative of exemplary embodiments, which achieve features and advantages of the present invention. Modification and substitutions to specific conditions and structures can be made without departing from the spirit and scope of the present invention. Accordingly, the invention is not to be limited by the foregoing description and drawings, but is only limited by the scope of the appended claims.

What is claimed is:

1. An over-current protection circuit for use with a constant voltage circuit that converts an input voltage to a predetermined output voltage and that outputs the predetermined output voltage, the over-current protection circuit comprising:

an output current detecting circuit configured to output an output current detecting voltage proportional to an output current outputted from the constant voltage circuit;

an output current control circuit configured to control the output current outputted from the constant voltage circuit according to the output current detecting voltage outputted from the output current detecting circuit;

an output voltage detecting circuit configured to output at least an output voltage detecting voltage according to the output voltage of the constant voltage circuit;

a conversion rate altering circuit configured to alter a conversion rate of the output current to the output current detecting voltage of the output current detecting circuit according to the output voltage detecting voltage outputted from the output voltage detecting circuit; and a switch device that is capable of operating the output voltage detecting circuit when the output current is greater than a predetermined current value, wherein the switch device includes a first transistor that is connected to the input voltage and the output voltage detecting circuit, the first transistor having a same conductivity type as an output control transistor of the constant voltage circuit that controls the output voltage of the constant voltage circuit, wherein a source and a gate of the first transistor are connected to a source and a gate of the output control transistor respectively, and wherein a threshold voltage of the first transistor is greater than a threshold voltage of the output control transistor.

2. The over-current protection circuit of claim 1, wherein the output current detecting circuit includes a second transistor, a first resistance, a second resistance and a third resistance, wherein the second transistor is connected between the input voltage and a reference voltage in series, the second transistor having a same conductivity type as the output control transistor and having a source and a gate connected to the source and the gate of the output control transistor respectively, wherein the output voltage detecting circuit includes a first current source, a fourth resistance, a fifth resistance and a second current source serially connected between the switch device and the reference voltage, wherein the conversion rate altering circuit includes a third transistor and a fourth transistor, wherein the third transistor has a drain connected to a first connection node between the first resistance and the second resistance and a source connected to the reference voltage, the third transistor having a conductivity type opposite the conductivity type of the output control transistor, wherein the fourth transistor has a drain connected to a second connection node between the second resistance and the third resistance and a source connected to the reference voltage, the fourth transistor having a conductivity type opposite the conductivity type of the output control transistor, and wherein the output voltage of the output control transistor is connected to a third connection node between the forth resistance and fifth resistance of the output voltage detecting circuit.

3. An over-current protection circuit of claim 2, further comprising a capacitor having a first terminal and a second terminal, wherein the first terminal is connected to a fourth connection node between the first current source and the fourth resistance, and wherein the second terminal is connected to the reference voltage.

4. An over-current protection circuit of claim 2, further comprising a capacitor having a first terminal and a second terminal, wherein the first terminal is connected to a fifth connection node between the second current source and the fifth resistance, and wherein the second terminal is connected to the reference voltage.

5. An over-current protection circuit of claim 2, further comprising a capacitor having a first terminal and a second terminal, wherein the first terminal is connected to a point along the series combination of the fourth and fifth resistances, and wherein the second terminal is connected to the reference voltage.

* * * * *